United States Patent [19]

Saito et al.

[11] 4,369,036

[45] Jan. 18, 1983

[54] METHOD OF MODIFYING SYNTHETIC OR NATURAL POLYAMIDE PRODUCTS

[75] Inventors: Koichi Saito, Kusatsu; Tatsuku Kojima, Uji; Yoshikazu Kosaka, Otsu, all of Japan

[73] Assignee: Toray Industries, Inc., Tokyo, Japan

[21] Appl. No.: 213,032

[22] Filed: Dec. 4, 1980

[51] Int. Cl.[3] ..... D06M 15/14

[52] U.S. Cl. ..... 8/115.5; 8/115.7; 8/128 R; 8/94.1 R; 8/128 A; 525/426

[58] Field of Search ..... 525/426; 8/115.5, 115.7, 8/128 R, 128 A, 94.1 R

[56] References Cited

U.S. PATENT DOCUMENTS

| | | | |
|---|---|---|---|
| 3,201,336 | 8/1965 | Magat et al. | 204/154 |
| 3,394,985 | 7/1968 | Froehlich | 8/115.5 |
| 3,495,930 | 2/1970 | Machell | 8/115.5 |
| 3,843,320 | 10/1974 | Feairheller et al. | 8/94.21 |
| 3,909,195 | 9/1975 | Machell | 8/128 A |
| 4,065,256 | 12/1977 | Igeta et al. | 8/115.7 |

FOREIGN PATENT DOCUMENTS

| | | | |
|---|---|---|---|
| 49-6157 | 2/1974 | Japan | 525/426 |
| 809838 | 3/1959 | United Kingdom . | |
| 856329 | 12/1960 | United Kingdom . | |
| 872514 | 7/1961 | United Kingdom . | |

*Primary Examiner*—Maria Parrish Tungol
*Attorney, Agent, or Firm*—Wegner & Bretschneider

[57] ABSTRACT

The present invention discloses a method of modifying a synthetic or natural polyamide product. A graft polymerization is carried out on the polyamide product in a solution containing 5 to 60 mole % of acrylic acid and 95 to 40 mole % of methacrylic acid as the monomer by means of a redox catalyst.

12 Claims, 1 Drawing Figure

METHOD OF MODIFYING SYNTHETIC OR NATURAL POLYAMIDE PRODUCTS

BACKGROUND OF THE INVENTION

This invention relates to a method of modifying a synthetic or natural polyamide product by means of a graft polymerization treatment.

Although various attempts have been made to modify synthetic or natural polyamide-type products by graft polymerization, few methods are industrially feasible and capable of utilizing a graft monomer efficiently. Methods of graft-polymerizing an acidic vinyl monomer to a polyamide-type product are described in various references such as Japanese Patent Publication Nos. 8543/1958, 7248/1959, 9283/1959, and 7834/1960. However, although these methods make it possible to graft the monomer on a laboratory scale, they call for radioactive irradiation or are disadvantageous in that the efficiency of utilization of the monomer (hereinafter called the "grafting efficiency") is as low as 30% or below. Thus, they are not feasible on an industrial scale.

SUMMARY OF THE INVENTION

The present invention is therefore directed to provide a novel graft-polymerization method which solves the abovementioned problems encountered in the prior art, which makes it possible to carry out graft polymerization on an industrial scale easily and which improves the grafting efficiency of acidic vinyl monomers.

BRIEF DESCRIPTION OF THE DRAWING

The sole accompanying drawing illustrates the change in grafting ratio when the graft polymerization is carried out under the polymerization conditions in Example 4 below by adjusting in various ways the blend ratio of acrylic acid and methacrylic acid and the total monomer amount to 60%, 100% and 220% owf (based "on the weight of the fabric" to be treated), respectively.

DESCRIPTION OF THE PREFERRED EMBODIMENTS

Figure 1:
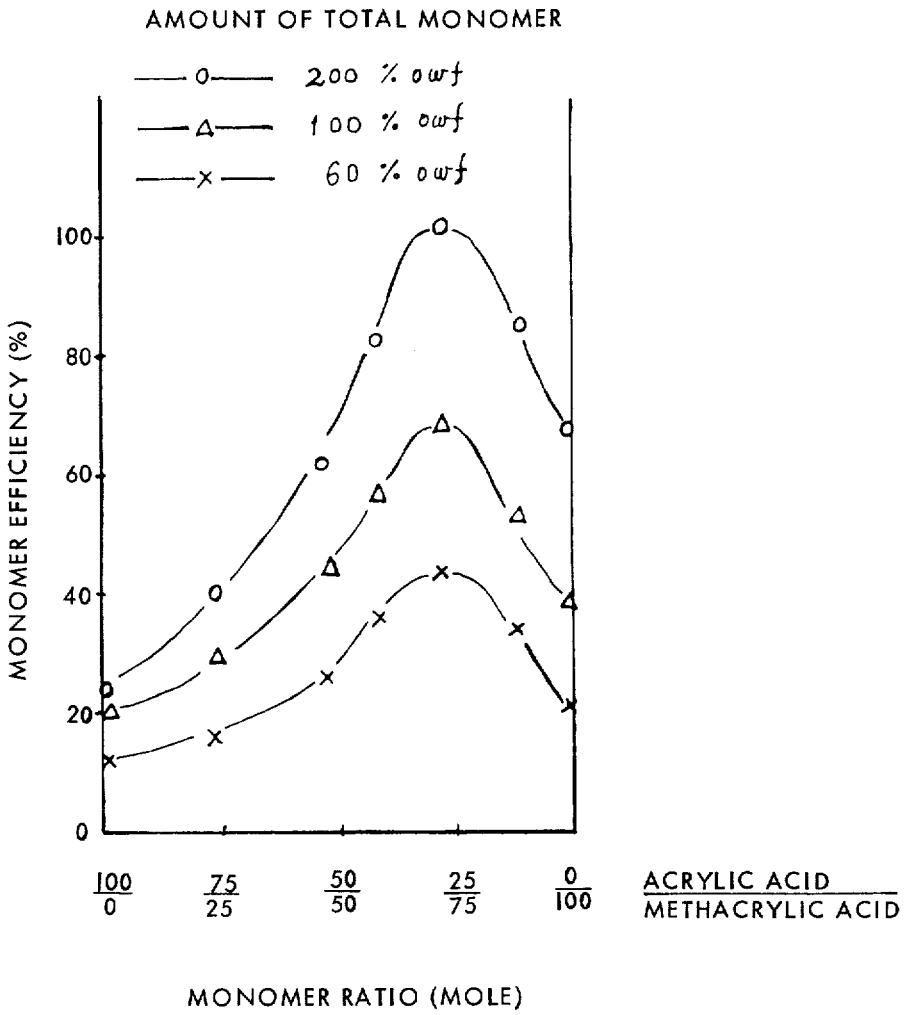

To accomplish the abovementioned objects, the present invention provides a method of modifying a synthetic or natural polyamide product wherein, in modifying a synthetic or natural polyamide product by means of graft polymerization, the graft polymerization is carried out in an aqueous solution containing 5 to 60 mole % of acrylic acid and 95 to 40 mole % of methacrylic acid as the monomer or wherein this aqueous solution is added to the polymerization system. Furthermore, another particular feature of the present invention is that after the abovementioned graft polymerization is carried out, a carboxylic acid group of the resulting polymer is converted into a metal or ammonium salt thereof.

The graft polymerization may be carried out by activating in advance the product to be graft-polymerized in an aqueous solution or a dispersion of a peroxide, such as ammonium persulfate or benzoyl peroxide, and then heating it in an aqueous solution of the blend of the acidic vinyl monomer defined in the present invention. Alternatively, the graft polymerization may be carried out in a redox system with the abovementioned radical initiator and a reducing agent together added in a weight ratio of from 1:1 to 1:20. To attain a higher grafting efficiency as the object of the present invention, the latter alternative provides better results and hence is preferred.

When a peroxide alone is employed as the radical polymerization initiator, the graft polymerization is generally carried out by applying in advance the aqueous solution of the monomer to the product (by dip-nip treatment using a mangle, or by applying by spraying or coating, for example) and then heating the reaction system to a temperature of 90° to 100° C., through this will vary to some extent depending upon the monomer composition. When the graft polymerization is carried out after dipping the product, the general procedure is to heat the reaction system to a temperature of 90° to 110° C. and then treat it for 50 to 120 minutes. When the peroxide and the reducing agent are used in combination as the radical initiator, that is, when a so-called redox catalyst is employed, it is customary to leave standing the product to be graft-polymerized, which is to be heated after application thereof of the aqueous monomer solution, at 10° to 70° C. for 1 to 40 hours, or to effect steaming of the product at 90° to 110° C. for 1 to 10 minutes, though the temperature and time vary with the kind and amount of the catalyst used. When the product is dipped into the aqueous monomer solution, the polymerization treatment is generally conducted at 20° to 90° C. for 5 to 120 minutes.

As examples of the peroxide to be employed for the graft polymerization, mention can be made of those peroxides which have high oxidizing force, such as potassium persulfate, ammonium persulfate, hydrogen peroxide and benzoyl peroxide. Of these, ammonium persulfate and potassium persulfate are preferable because they are water-soluble and have high activation properties.

Examples of the reducing agent include hydrogen iodide hydrogen sulfide, lithium aluminum hydride, sodium borohydride, sulfur dioxide, sodium sulfite, sodium sulfide, sodium bisulfite, sodium hydrosulfite, a reaction product between sodium sulfoxylate and formalin, and so forth. Among them, the reaction product between sodium sulfoxylate and formalin and sodium hydrosulfite exhibit especially large effect. The presence of the air exerts hardly any influence on the polymerization, hence purging with nitrogen or steam is not necessary. Addition of a sequestering agent such as tripolyphosphate or ethylenediaminetetraacetate (EDTA) to the aqueous solution of the graft polymerization provides a preferable result. The polymerization is preferably carried out on the acidic side below pH 7, through the pH of the aqueous solution does not impose any restriction.

Using a predetermined composition of acrylic acid and methacrylic acid preferably in combination with a peroxide and a reducing agent, the method of the present invention reduces the graft-polymerization time to $\frac{1}{2}$ to $\frac{1}{3}$ that required by the conventional methods, saves energy, markedly improves workability and provides an unexpectedly great improvement in the grafting efficiency. Accordingly, the method of the present invention has great advantages for the industrial application in that the monomer efficiency is high without wasting the monomer or homopolymer, and in that contamination due to the outflow of the monomer or homopolymer into effluent is minimized, thereby preventing possible environmental pollution.

In the modifying treatment of the polyamide product by the graft polymerization as described above, the utilization efficiency of the monomer is enhanced by adjusting the blend ratio of acrylic acid and methacrylic acid in the abovementioned aqueous solution to 10 to 45 mole % and 90 to 55 mole %, respectively, in comparison with cases where acrylic acid and methacrylic acid are individually graft-polymerized, respectively. This is illustrated in FIG. 1. If the blend ratio of acrylic acid and methacrylic acid in the aqueous solution is changed to 20 to 35 mole % and 80 to 65 mole %, respectively, the utilization efficiency is remarkably improved as shown also in FIG. 1, thus making it possible to accomplish the objects of the invention in an extremely effective manner.

The term "synthetic polyamide product" used herein denotes fibers, films and other molded articles fabricated from such amide polymers and copolymers, such as nylon 6, nylon 6·6, nylon 8, nylon 10, nylon 12, and nylon 6·10. In particular, the method of the present invention is applied especially preferable to fiber products, such as filaments, yarns, knitted fabrics, woven and non-woven fabrics, slivers, and tows. Insofar as the objects of the present invention can be accomplished without specific problems, other polymers or other fabrics, such as union fabrics, mix knitted fabrics and mixed spun fabrics, may naturally be mixed with the abovementioned polymers or fabrics.

The term "natural polyamide product" used herein denotes those products which are fabricated from natural materials having amide group(s) in their molecules, such as silk, wool, and natural leathers.

The method of the present invention applies graft polymerization to the abovementioned synthetic or natural polyamide product and exhibits especially high grafting to the nylon 6 or nylon 6·6 synthetic polyamide products, thereby providing an extremely high grafting efficiency (monomer utilization efficiency).

If a film or a synthetic leather made of polyamide is subjected to the abovementioned graft-polymerization treatment in accordance with the method of the present invention, it is possible to obtain a film or leather having a grafting ratio of a degree that cannot be attained by the heretofore-known graft-polymerization method. If the carboxyl group of the grafted product is substituted by an alkali metal such as sodium or potassium, or by ammonium, it is possible to obtain a film or leather product having a high electric conductivity and a high moisture permeability. If the leather product thus obtained is used for shoes, it is possible to obtain a hygienic product which does not become hot and stuffy on the feet. If the carboxyl group is substituted by lead or copper after the graft polymerization with acrylic acid and/or methacrylic acid, a product having high specific gravity can be obtained. Furthermore, the heat resistance of the product can be enhanced by substituting the carboxyl group of the product by calcium, sodium or potassium. In other words, it becomes possible to furnish the product with so-called "melt resistance."

EXAMPLES 1-5, COMPARATIVE EXAMPLES 1-4

Filaments (150D-48f) consisting of nylon 6 were woven into a taffeta. After the taffeta was subjected to hot water washing and scouring, dipping-and-heating graft polymerization was carried out with each monomer ratio illustrated below to yield a grafted woven fabric having a high monomer utilization efficiency.

Example

| | | |
|---|---|---|
| 1. | Total of acrylic acid and methacrylic acid 60% owf (percentage based on the weight of the fabric to be treated) with a monomer ratio as follows: | |
| | acrylic acid | 28 mole % |
| | methacrylic acid | 72 mole % |
| 2. | Same as Example 1 with a monomer ratio as follows: | |
| | acrylic acid | 40 mole % |
| | methacrylic acid | 60 mole % |
| 3. | Same as Example 1 with a monomer ratio as follows: | |
| | acrylic acid | 15 mole % |
| | methacrylic acid | 85 mole % |
| 4. | Same as Example 1 with a monomer ratio as follows: | |
| | acrylic acid | 50 mole % |
| | methacrylic acid | 50 mole % |
| 5. | Same as Example 1 with a monomer ratio as follows: | |
| | acrylic acid | 6 mole % |
| | methacrylic acid | 94 mole % |

Each reaction was carried out using 1% owf of ammonium persulfate and 3% owf of a reaction product between sodium sulfoxylate and formalin as the graft-polymerization initiator and 0.3 g/l of sodium ethylenediaminetetraacetate as the sequestering agent. The temperature was gradually elevated from 40° C. to 80° C. in the course of 30 minutes at a bath ratio of 1:10, and was retained at 80° C. for 60 minutes. The resulting product was then washed with water and dried and the graft ratio was determined in terms of the ratio of the increase in weight. The results are illustrated in Table 1 below.

For comparison, the reactions were also carried out using the same monomer in the same amount (60% owf), the same catalyst and the same sequestering agent under the same condition as above except that each of the following monomer ratio was employed.

Comparative Examples

| | | |
|---|---|---|
| 1 | acrylic acid alone | |
| 2 | methacrylic acid alone | |
| 3 | acrylic acid | 70 mole % |
| | methacrylic acid | 30 mole % |
| 4 | acrylic acid | 3 mole % |
| | methacrylic acid | 97 mole % |

However, the objects of the invention could not be accomplished as the monomer efficiency was extremely low.

TABLE 1

| | Monomer Blend (mole %) | | Monomer Amount | Grafting | Monomer Efficiency |
|---|---|---|---|---|---|
| | AA | MA | (% owf) | Ratio % | (%) |
| Example | | | | | |
| 1 | 28 | 72 | 60 | 45.0 | 75 |
| 2 | 40 | 60 | 60 | 34.8 | 58 |
| 3 | 15 | 85 | 60 | 37.2 | 62 |
| 4 | 50 | 50 | 60 | 25.8 | 43 |
| 5 | 6 | 94 | 60 | 30.0 | 50 |
| Com. Ex. | | | | | |
| 1 | 100 | 0 | 60 | 13.2 | 22 |
| 2 | 0 | 100 | 60 | 22.8 | 38 |
| 3 | 70 | 30 | 60 | 16.8 | 28 |
| 4 | 3 | 97 | 60 | 24.0 | 40 |

AA: acrylic acid
MA: methacrylic acid

EXAMPLE 6

Each of the fibers illustrated in Table 2 below was subjected to the graft-polymerization treatment under the same conditions as in Example 1. As a result, it was found that nylon 6 and nylon 6·6 exhibited remarkable graftability and that wool and silk could also be grafted. It was also found, on the other hand, that polyester and polyacrylonitrile could hardly be grafted.

TABLE 2

| Fiber | Grafting Ratio (%) |
|---|---|
| Nylon 6 | 45 |
| Nylon 6 · 6 | 43 |
| Wool | 13 |
| Silk | 11 |
| Polyester | 0.7 |
| Polyacrylonitrile | 0.5 |
| Cotton | 0.2 |

EXAMPLE 7

Staple, tow and top, each of 3 deniers and consisting of nylon 6, were packed in a package dyeing machine and were graft-polymerized, respectively, using 40% owf of a blend monomer (28 mole % acrylic acid and 72 mole % of methacrylic acid), 1% owf of ammonium persulfate and 3% owf of a reaction product between sodium sulfoxylate and formalin as the initiator and 0.3 g/l of disodium ethylenediaminetetraacetate as a sequestering agent in a liquid volume of a bath ratio of 1:5 while the temperature was gradually elevated from 40° C. to 80° C. in the course of 30 minutes and was then held 80° C. for 60 minutes. There were thus obtained fibers having a grafting ratio of as high as 31%.

EXAMPLE 8

Hanks were separately prepared from twines of single fiber, spun yarn consisting of nylon 6 and having fineness of 3 deniers, two-ply yarn of a 10 yarn count, filament yarn of 420 deniers in total and textured yarn of 1,000 deniers in total. Each was then graft-polymerized under the same conditions as in Example 4 except that the bath ratio was changed to 1:20. There were thus obtained grafted products having a grafting ratio of as high as 25 to 30%.

EXAMPLE 9

Non-woven fabric, taffeta and taffeta and half-tricot knitted fabric, each consisting of nylon 6, were grafted polymerized under the same conditions as in Example 4 except that the bath ratio was changed to 1:10. There were thus obtained grafted cloths having a grafting ratio of as high as 27 to 32%.

EXAMPLE 10

Various socks and pants-stocking products, each consisting of textured yarn of nylon 6, were graft-polymerized using a stainless pot under the same conditions as in Example 4 except that the amount blend ratio of the monomers were changed to 10% owf and 28 mole % acrylic acid and 72 mole % methacrylic acid, respectively, and the bath ratio was also changed to 1.25. There were thus obtained grafted products having an extremely high monomer efficiency (grafting ratio of 8.2%). When the products were treated with 20% owf of an aqueous sodium carbonate solution at 70° C. for 30 minutes, they became products having excellent water absorbency, hygroscopicity, antistatic property and soil resistance.

EXAMPLE 11

A stretched film consisting of nylon 6 was graft-polymerized using 50 g/l of the blend monomer of Example 4, 2% owf of ammonium persulfate and 6% owf of a reaction product between sodium sulfoxylate and formalin as the initiator and 0.3 g/l of sodium ethylenediaminetetraacetate as the sequestering agent at a bath ratio of 1:200 with the other polymerization conditions such as the temperature and time being the same as those of Example 4. There was thus obtained a grafted film having a high grafting ratio of 35%. When the resulting film was treated with 50% owf of an aqueous sodium carbonate solution, there was obtained a film having excellent antistatic property, moisture permeability and melt resistance.

EXAMPLE 12

A leather-like cloth consisting of ultra-thin polyamide fiber having the fineness of a single fiber of 0.2 denier and polyurethane was graft-polymerized in the same way as in Example 7, thus yielding a cloth having excellent moisture regaining property as well as moisture permeability.

EXAMPLE 13

The same woven cloth as Example 1 was graft-polymerized under the same conditions as in Example 1. Thereafter, the product was treated at 80° C. for 30 minutes using a 60% owf aqueous solution of each of the metal salts listed below to furnish products with various properties. The results are illustrated below.

TABLE 3

| Metal Salt Used | Moisture Regain | Frictional Static Voltage | Soil Resistance | Melt Resistance | Specific Gravity |
|---|---|---|---|---|---|
| $Na_2CO_3$ | 42% | 4 V | 0.5% | 5th grade | 1.18 |
| $K_2CO_3$ | 43 | 3 | 0.4 | 5 | 1.17 |
| $CaCl_2$ | 4.5 | 4,500 | 21.5 | 5 | 1.21 |
| $CuCl_2$ | 4.2 | 1,100 | 22.5 | 4 | 1.35 |
| $Pb(CH_3COO)_2 \cdot Pb(OH)_2$ | 4.3 | 4,700 | 25.5 | 4 | 1.87 |
| — | 4.4 | 4,600 | 23.5 | 2 | 1.14 |
| non-grafted nylon | 4.3 | 4,700 | 21.7 | 1 | 1.14 |

(1) Measurement of Hygroscopicity (Moisture Regain)

One gram of the sample was placed in a weighing bottle and was dried at 105° C. for 2 hours. The weight $W_o$ at that time was measured. Next, the sample was placed in a desiccator containing a saturated $NaNO_2$ solution and was left standing at 20° C. for 24 hours. The weight W at that time was measured. The hygroscopicity was determined in accordance with the following formula:

$$\text{hygroscopicity} = \frac{W - W_o}{W_o} \times 100$$

(2) Measurement of Frictional Static Voltage

A sample having a length of 8 cm and a width of 5 cm was collected. As a cloth to be rubbed, a cotton cloth of No. 3 shirting was used. After the sample was left standing at 20° C. and 30% R.H. for one day and night, it was rotated for 60 seconds using a static tester (Kyoto University type, a product of Koa Shokai) to determine the static voltage (V).

(3) Measurement of Soil Release 5 cc of a soiling agent listed below, 200 cc of water and 10 pieces of steel balls were placed in a 500 cc pot. Four samples having a width of 5 cm and a length of 10 cm were placed in the pot and were treated at 60° C. for 30 minutes using a Laund-O-meter. Each of the soiled samples was washed during "Super Zabu" (detergent, a product of Kao Sekken K.K.) and a washing machine for home use, and was then dried. The L value of the sample was measured using a Hunter color difference meter and the soil release (%) was determined in accordance with the following formula:

$$\text{soil release (\%)} = \frac{L \text{ value before contamination} - L \text{ value after contamination}}{L \text{ value before contamination}} \times 100$$

| | |
|---|---|
| Soiling agent: | |
| Esso automatic transmission fluid | 300 g |
| Coal tar | 3 g |
| Portland cement | 5 g |
| Detergent: | |
| "Super Zabu" (Kao Sekken K.K.) | 5 g |

Generally, the soil release is at a satisfactory level if it is below 10%.

(4) Measurement of Melt Resistance

A sample was placed on a 7 mm-diameter iron rod heated to 360° C. and was brought into contact with the iron rod for 5 seconds. The extent of hole melting at that time was measured at melt resistance.

Melt resistance 5th grade: No hole was formed.

Melt resistance 4th grade: Sample was transparent, though no hole was formed.

Melt resistance 3rd grade: Sample was fairly transparent, though no hole was formed.

Melt resistance 2nd grade: A hole was formed to a considerable extent.

Melt resistance 1st grade: Hole was formed completely.

(5) Measurement of Specific Gravity

The specific gravity was measured in terms of precipitation speed when a sample was placed in aqueous sulfuric acid solutions or varying concentration as stock solutions of various specific gravities.

EXAMPLE 14

A tricot consisting of a sheath-core fiber of 3 denier consisting of 70 wt.% of nylon 6 (sheath) and 30 wt.% of polyester (core), was graft-polymerized under the same conditions as in Example 1, yielding a highly grafted product having high dimensional stability.

The resulting product was treated in an aqueous solution of 40 g/l of caustic soda (solid) at 98° C. for 30 minutes to dissolve the polyester component by 15% in terms of weight reduction ratio. There was thus obtained a cloth which was highly rich in drapability and which had high dimensional stability in addition to a moisure regain, antistatic property and soil release property.

EXAMPLE 15

Mixed filament yarn consisting of 50 wt.% nylon 6 and 50 wt.% of polyester was knitted into a tricot in the same way as Example 10, which was then graft-polymerized under the same condition as in Example 10. There was thus obtained a cloth which was high in drapability, had high dimensional stability in addition to moisture regain, antistatic property, and so forth.

What is claimed is:

1. A method of modifying a synthetic polyamide product wherein a synthetic polyamide product is modified by means of graft polymerization is carried out on said product using a redox catalyst in an aqueous solution containing 5 to 60 mole% of acrylic acid and 95 to 40 mole % of methacrylic acid as the monomer and thereafter a carboxylic acid group in the product is converted into metal or ammonium salt thereof.

2. The method as defined in claim 1 wherein said aqueous solution contains 10 to 45 mole % of acrylic acid and 90 to 55 mole % of methacrylic acid as the monomer.

3. The method as defined in claim 1 wherein said aqueous solution contains 20 to 35 mole % of acrylic acid and 80 to 65 mole % of methacrylic acid as the monomer.

4. The method as defined in claim 1 wherein said polyamide product is a staple, a tow or a top.

5. The method as defined in claim 1 wherein said polyamide product is a spun yarn.

6. The method as defined in claim 1 wherein said polyamide product is a filament.

7. The method as defined in claim 1 wherein said polyamide product is a cloth.

8. The method as defined in any of claims 7 through 8 wherein said synthetic polyamide product is nylon 6.

9. The method as defined in any of claims 7 through 8 wherein said synthetic polyamide product is nylon 6·6.

10. The method defined in any of claims 7 through 8 wherein said polyamide product is a fiber product.

11. The method as defined in claim 1 wherein said polyamide product is a film.

12. The method as defined in claim 1 wherein said polyamide product is a leather-like cloth.

* * * * *